US008303673B2

(12) United States Patent
Fischer et al.

(10) Patent No.: US 8,303,673 B2
(45) Date of Patent: Nov. 6, 2012

(54) METHOD AND DEVICE FOR A HIGH-CAPACITY ENTRAINED FLOW GASIFIER

(75) Inventors: Norbert Fischer, Lichtenberg (DE); Manfred Schingnitz, Freiberg (DE)

(73) Assignee: Siemens Aktiengesellschaft, München (DE)

( * ) Notice: Subject to any disclaimer, the term of this patent is extended or adjusted under 35 U.S.C. 154(b) by 642 days.

(21) Appl. No.: 11/510,455

(22) Filed: Aug. 25, 2006

(65) Prior Publication Data

US 2008/0047196 A1 Feb. 28, 2008

(51) Int. Cl.
*B01J 7/00* (2006.01)
*H01M 8/06* (2006.01)

(52) U.S. Cl. ..... 48/61

(58) Field of Classification Search ..... 48/197 R, 48/61; 431/278–285
See application file for complete search history.

(56) References Cited

U.S. PATENT DOCUMENTS

| | | | | |
|---|---|---|---|---|
| 3,988,123 | A | 10/1976 | Coates | |
| 4,781,731 | A | 11/1988 | Schlinger | |
| 4,971,550 | A | 11/1990 | Schingnitz et al. | |
| 5,224,338 | A * | 7/1993 | Fujioka et al. | 60/780 |
| 5,725,615 | A | 3/1998 | Morihara et al. | |
| 5,968,212 | A | 10/1999 | Peise et al. | |
| 6,209,310 | B1 * | 4/2001 | Kuenzi et al. | 60/775 |
| 2004/0261316 | A1 | 12/2004 | Weaver | |
| 2007/0079554 | A1 * | 4/2007 | Schingnitz et al. | 48/210 |
| 2007/0082306 | A1 * | 4/2007 | Drnevich et al. | 431/12 |

FOREIGN PATENT DOCUMENTS

| | | | |
|---|---|---|---|
| CN | 2700718 | | 5/2005 |
| DE | 197 131 | A1 | 10/1905 |
| DE | 35 34 015 | | 4/1986 |
| DE | 44 46 803 | | 6/1996 |
| DE | 197 18 131 | | 11/1998 |
| EP | 0 677 567 | | 9/1997 |
| GB | 2004993 | A * | 4/1979 |
| GB | 2164951 | A | 4/1986 |
| WO | WO 96/17904 | | 6/1996 |

OTHER PUBLICATIONS

J. Carl, P. Fritz, Noell-Konversionsverfahren Noell Conversion Method for Waste Recycling and Waste Disposal, EF-Verlag für Energie-und Umwelttechnik GmbH, 1996, p. 27-68.

C. Higman and M. van der Burgt, "Gasification", Verlag Elsevier, USA, 2003.

* cited by examiner

*Primary Examiner* — Imran Akram
(74) *Attorney, Agent, or Firm* — Collard & Roe, P.C.

(57) ABSTRACT

A method and an apparatus for gasifying combustible dusts in an entrained flow gasifier with several gasification burners. Each gasification burner is associated with one or a plurality of lock hopper and dosing systems having a plurality of supply flows. This has the advantage that the burners will continue to operate in the event of a failure of one supply flow.

20 Claims, 8 Drawing Sheets

METHOD AND DEVICE FOR A HIGH-CAPACITY ENTRAINED FLOW GASIFIER

BACKGROUND OF THE INVENTION

1. Field of the Invention

One embodiment of the invention relates to a method for entrained flow gasification with very high capacity that can be used for supplying large scale syntheses with synthesis gas. A gasifier for use in this method is disclosed in U.S. patent application Ser. No. 11/359,608, the disclosure of which is herein incorporated by reference. The invention allows for conversion of combustibles processed into pulverized combustible dusts such as hard coal and lignite, petroleum coke, solid grindable residues but also solid-liquid suspensions, called slurries into synthesis gas. The combustible is thereby converted through partial oxidation into CO— and H.sub.2-containing gases at temperatures ranging from 1,200 to 1,900.degree. C. using a gasification agent containing free oxygen at pressures of up to 80 bar. This occurs in a gasification reactor having a multiple burner array and by a cooled gasification chamber.

2. The Prior Art

In a gas production technique, the autothermal entrained flow gasification of solid, liquid and gaseous combustibles has been known for many years. For reasons of synthesis gas quality, the ratio of combustible to oxygen-containing gasification agents is chosen such that higher carbon compounds are completely cleaved into synthesis gas components such as CO and H.sub.2 and that the inorganic constituents are discharged in the form of a molten slag.

According to different systems well known in the art, gasifying gas and molten slag can be discharged separately or together from the reaction chamber of the gasification apparatus, as this is shown in German Patent No. DE 197 18 131 A1. Systems provided with a refractory lining or cooled systems are known for bounding the reaction chamber structure of the gasification system from inside.

SUMMARY OF THE INVENTION

One embodiment of the invention can provide a gasification method that achieves the highest outputs of 500 to 1,500 MW while ensuring reliable and secure operation.

In high-performance entrained flow reactors, it is necessary to arrange a plurality of gasification burners if one wants to achieve secure conversion of the combustible. In order to ensure start up and secure operation of such reactors, a central ignition and pilot burner is disposed that is surrounded by 3 dust burners symmetrically spaced 120.degree. apart from each other. In order to allow introducing the large amounts of combustible dust of for example 100-400 t/h into the gasification reactor operated under pressure, a plurality of lock hopper and dosing systems are arranged for supplying dust to the gasification burners. It is also possible to associate a lock hopper and dosing system with each gasification burner. Another possibility is to connect each lock hopper and dosing system to a plurality of gasification burners in order to increase their availability.

One embodiment of invention provides a method in which one single lock hopper and dosing system is associated with each gasification burner. For this purpose, supply lines lead from each lock hopper and dosing system to a respective one of the gasification burners. Each of the burners may have three feed ports for these supply lines.

Further, supply lines may lead from each lock hopper and dosing system to the feed ports in the various gasification burners. The supply lines of three lock hopper and dosing systems may thus lead to different gasification burners so that three gasification burners each having three feed ports may be provided. Each feed port is supplied with combustible from another lock hopper and dosing system. There may be fewer lock hopper and dosing systems than gasification burners. Two lock hopper and dosing systems may, for example, supply combustible to three gasification burners through lines. The combustible dust of each lock hopper and dosing system is distributed evenly to the gasification burners through the respective supply lines. Providing a plurality of lock hopper and dosing systems offers the advantage that the burners will continue to operate steadily upon failure of one of them.

In case each gasification burner is supplied through at least two supply lines, one supply line is led from each lock hopper and dosing system to each burner so that redundancy is provided in the event of a system failure.

One embodiment of the invention has the advantage that all the gasification burners are supplied uniformly with combustible dust. In this manner, it is possible to mix combustible dusts from diverse lock hopper and dosing systems of the large plants in the gasification burner.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
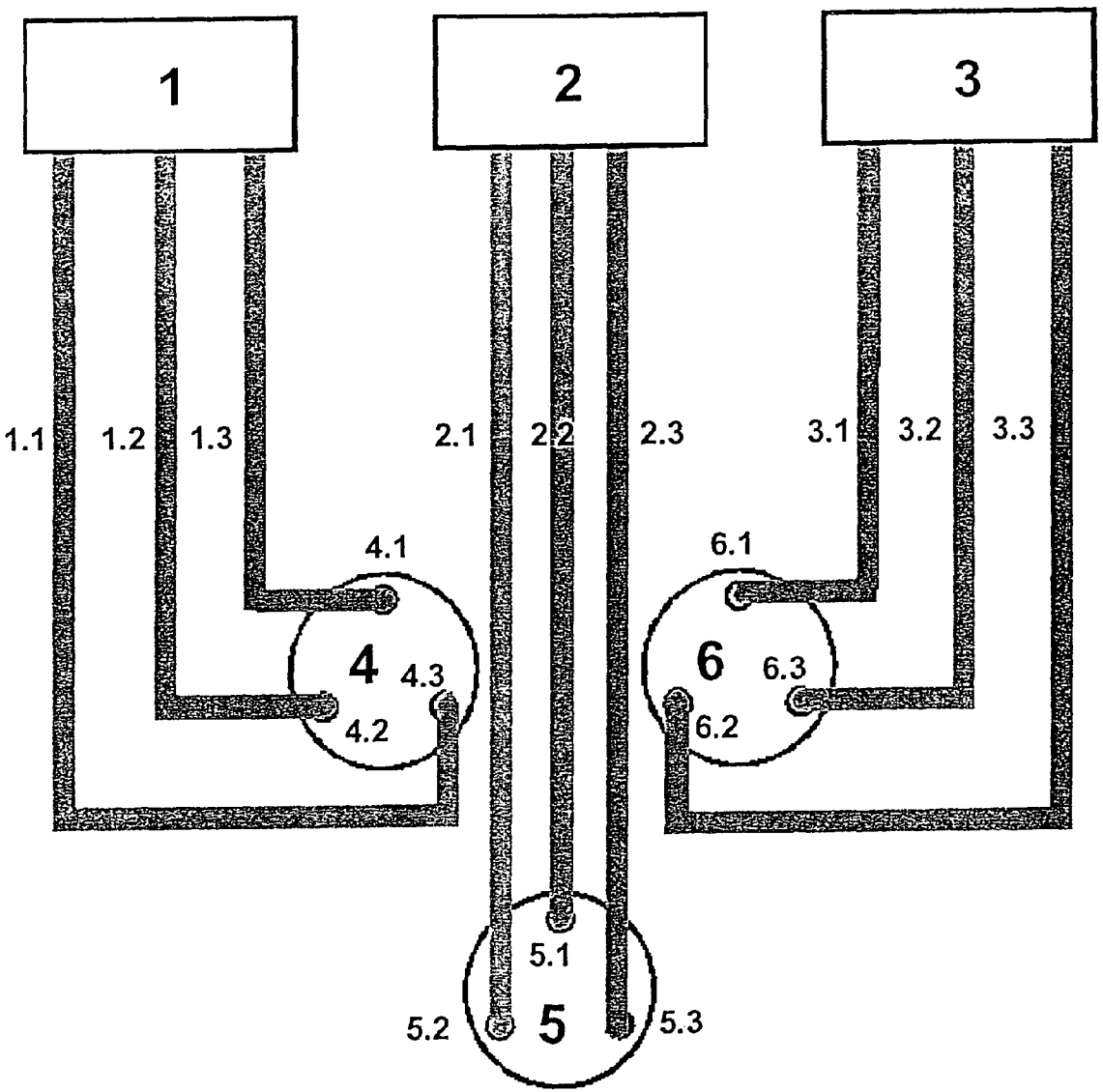
FIG. 1 shows an example in which each gasification burner is associated with one lock hopper and dosing system.

FIG. 1 shows an example in which each lock hopper and dosing system 1, 2, 3 is associated with one gasification burner 4, 5, 6. The objective is to feed a gasification reactor for entrained flow gasification of carbon dust with an gross input of 1,000 MW with the 180 Mg/h carbon dust needed for this purpose. For this purpose, there are three lock hopper and dosing systems 1, 2, 3 (FIG. 1), each supplying a gasification burner 4, 5, 6 through supply ports 4.1 through 6.3 thereof with 60 Mg/h combustible dust through three supply lines 1.1 through 3.3 with a feed capacity of 20 Mg/h. The capacity of each dust supply line 1.1 through 3.3 can be set in the range from 15-30 Mg/h. The three dust supply lines 1.1 through 3.3 of each lock hopper and dosing system 1, 2, 3 thereby end in a gasification burner 4, 5, 6, supplying it with the 60 Mg/h carbon dust mentioned. All three lock hopper and dosing systems 1, 2, 3 must be in operation. Operation with two of the three gasification burners 4, 5, 6 results in unacceptable crooked burning in the gasification reactor. In the event of a failure of only one of supply lines 1.1 through 3.3, burner 4, 5, 6 of concern may also be operated for a limited time with two supply lines.

Figure 2:
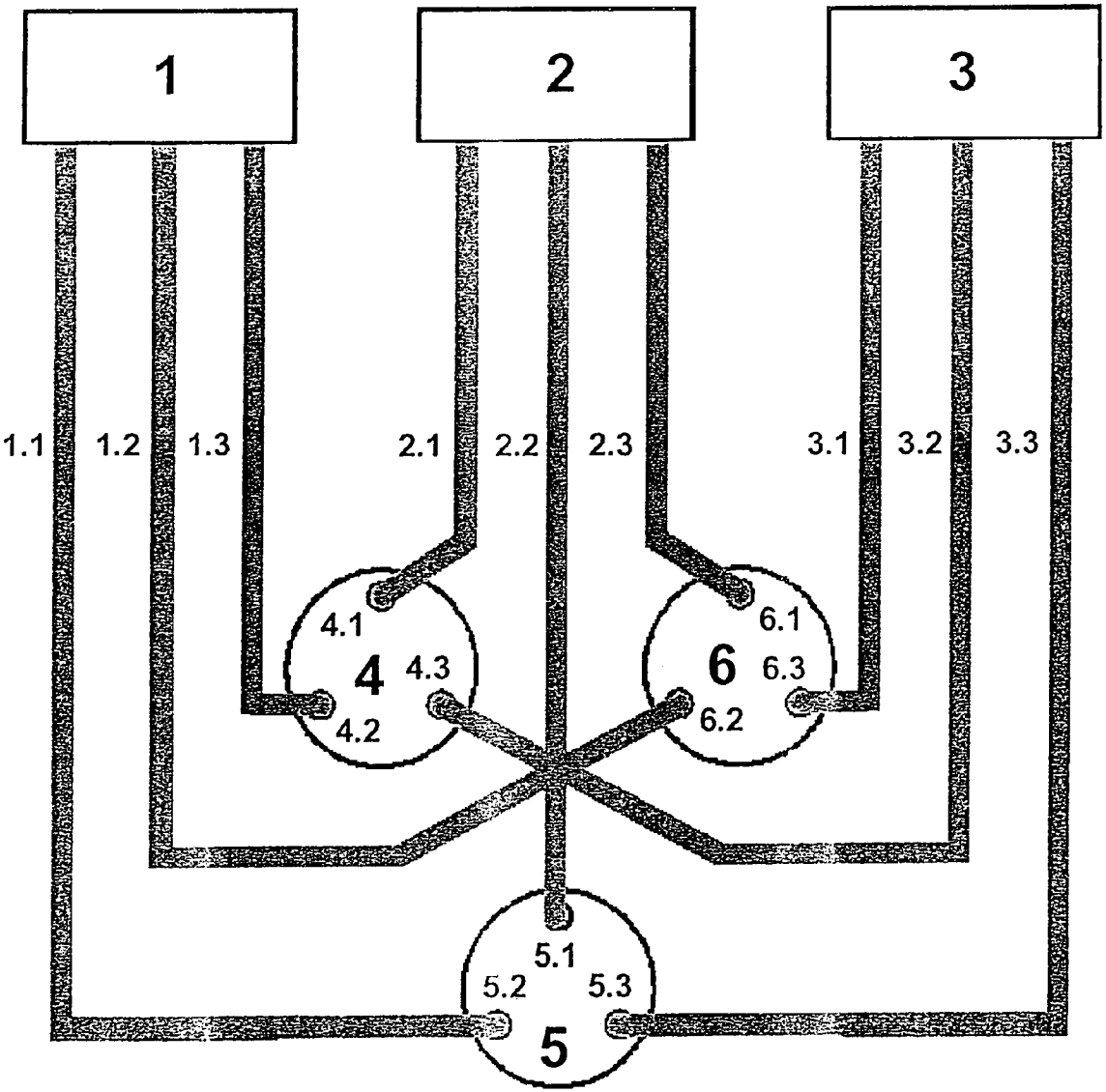
FIG. 2 shows an example in which three gasification burners are associated with three lock hoppers and dosing systems, whereas each dust burner has one feed line from each of the three lock hoppers and dosing systems.

FIG. 2 shows an example in which three lock hoppers and dosing systems 1, 2, 3 are associated with all three gasification burners 4, 5, 6. The objective is the same as in FIG. 1. However, the three supply pipes 1.1 through 3.3 of each lock hopper and dosing system 1, 2, 3 are not connected to one gasification burner, but with all the three. Upon failure of one lock hopper and dosing system 1, 2, 3, each gasification burner 4, 5, 6 may also be supplied for a limited time from the two still operating lock hopper and dosing systems 1, 2, 3.

Figure 3:
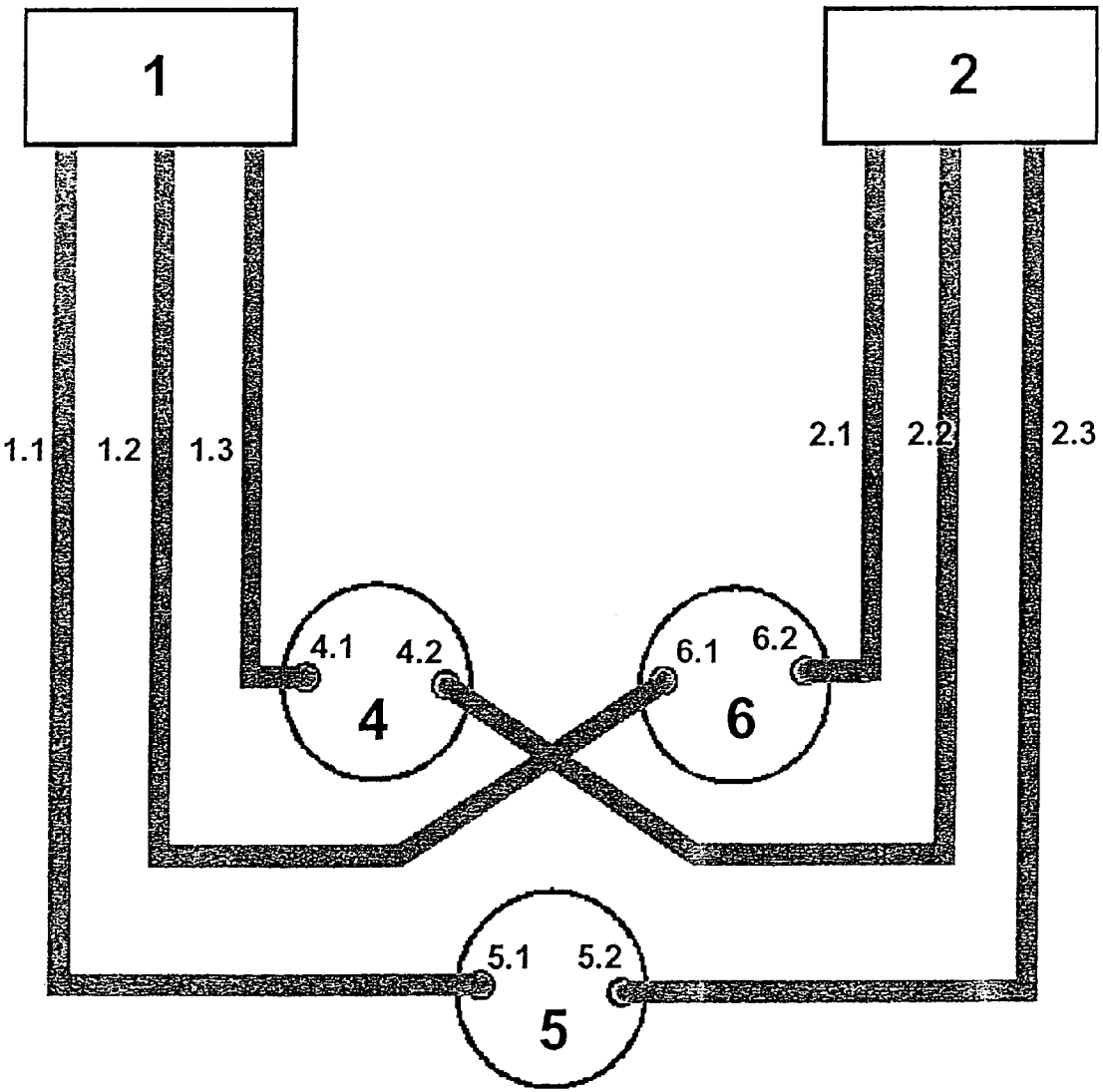
FIG. 3 shows an example in which three gasification burners are associated with two lock hoppers and dosing systems, whereas each gasification burner has one feed line from each of the two lock hoppers and dosing systems.

FIG. 3 shows two lock hopper and dosing systems 1, 2 which are connected to three gasification burners 4, 5, 6. The objective is to supply a gasification reactor for entrained flow gasification of carbon dust having an output of 500 MW with the 90 Mg/h carbon dust needed for this purpose. For this purpose, 2 lock hopper and dosing systems 1, 2, each having a capacity of 45 Mg/h, are arranged, each of the three supply lines 1.1 through 2.3 having an output of 15 Mg/h. Each gasification burner 4, 5, 6 is supplied from two supply lines 1.1 through 2.3 originating from a respective one of the lock hopper and dosing systems 1, 2. As a result, two lock hopper and dosing systems 1, 2 can be utilized for middle-performance gasification reactors having three gasification burners 4, 5, 6.

Figure 4:
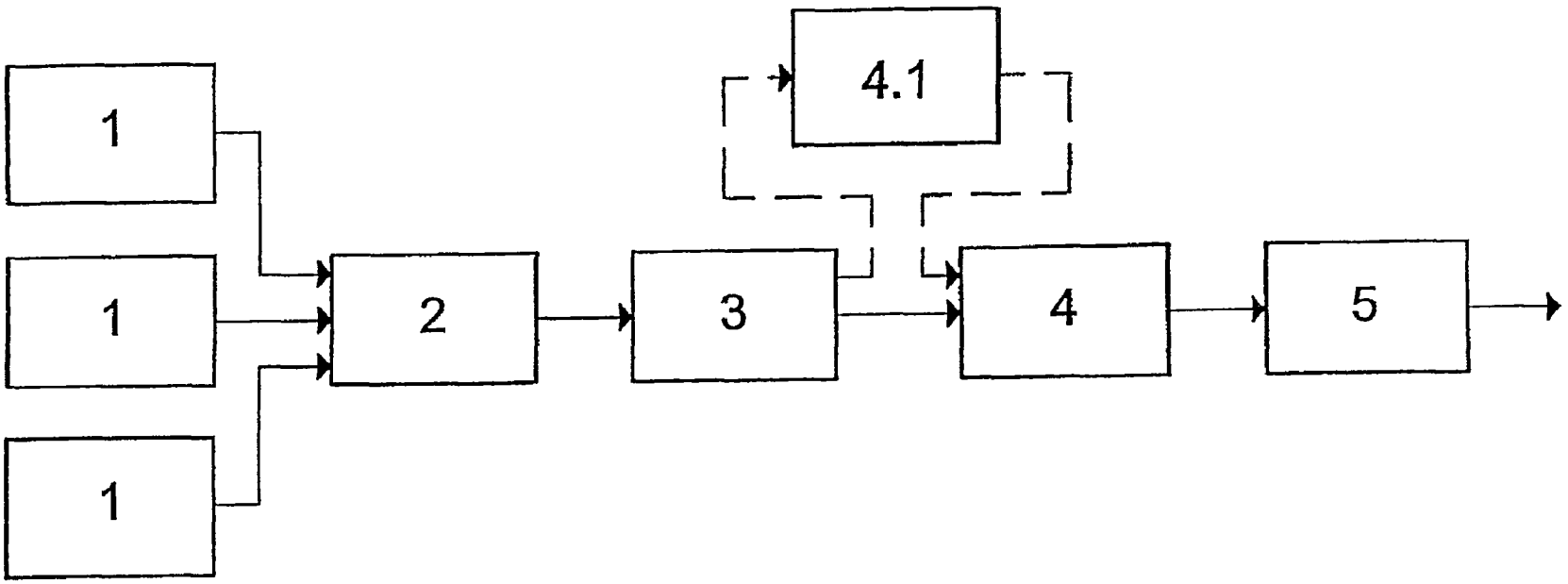
FIG. 4 shows a block diagram of the technology according to the invention.

FIG. 4 shows a block diagram of the process steps of pneumatic metering of pulverized fuel, gasification in a gasification reactor with cooled reaction chamber structure 2, quench-cooling 3, crude gas scrubbing 4, in which there can be a waste heat boiler 4.1 between the quench-cooling 3 and the crude gas scrubbing 4, and a condensation or partial condensation 5 follows the crude gas scrubber 4.

Figure 5:
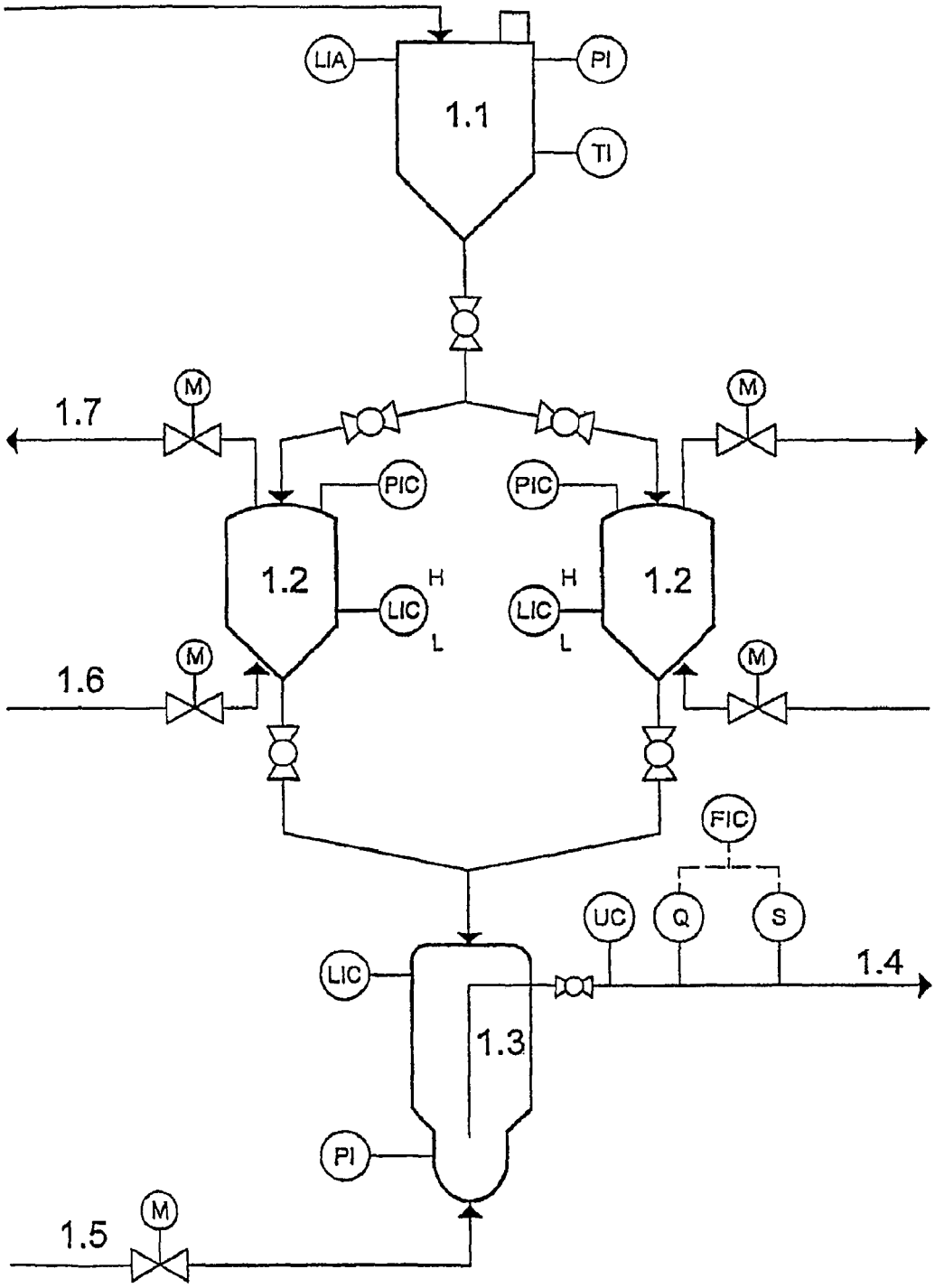
FIG. 5 shows a metering system for pulverized fuel according to the invention.

FIG. 5 shows a metering system for pulverized fuel consisting of a bunker 1.1 followed by two pressurized sluices 1.2, into which lead lines 1.6 for inert gas, and at the top of which depressurization lines 1.7 exit, with lines to the metering tank 1.3 leaving the pressurized sluices 1.2 from the bottom. There are fittings on the pressurized sluices 1.2 for monitoring and regulating. A line 1.5 for fluidizing gas leads into the metering tank from below, which provides for fluidizing the gas, and the fluidized pulverized fuel is fed through the transport line 1.4 to a gasification reactor 2.

Figure 6:
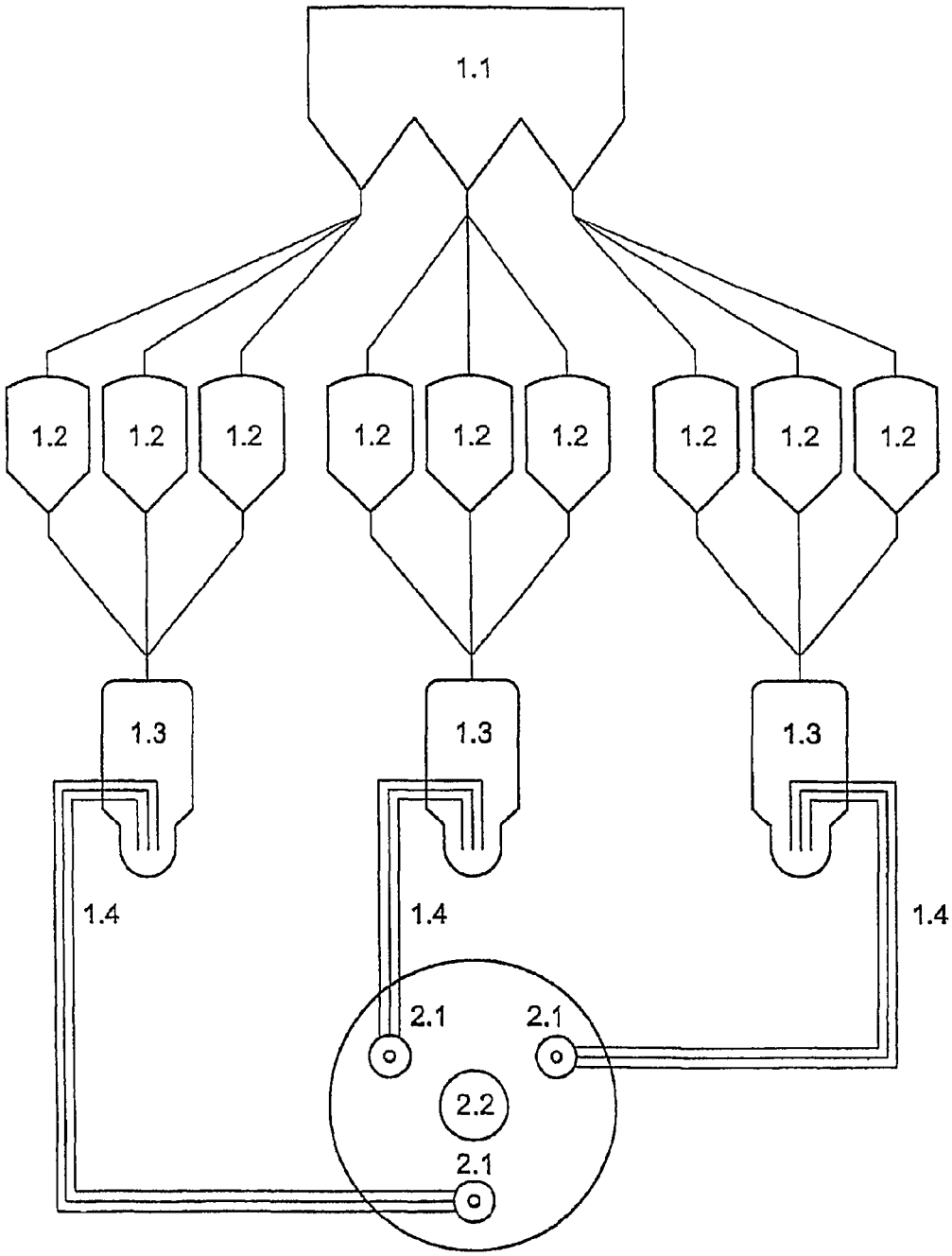
FIG. 6 shows a device for feeding pulverized fuel for high-capacity generators.

FIG. 6 shows another design of the device for feeding pulverized fuel for high-capacity generators 2, wherein a bunker 1.1 has three discharges for pulverized fuel, each leading to pressurized sluices 1.2, with each of the three pressurized sluices transporting pulverized fuel streams to one of three metering tanks 1.3, from which transport lines 1.3 lead to the dust burners 1.2 with oxygen infeed of the reactor. There are three dust burners 2.1 on each reactor 2 with oxygen feed, with an ignition and pilot burner 2.2 to start the reaction. Because of such intensive fluidized fuel flows and the presence of three burners 2.1, it is possible to achieve maximum capacities of 1,000 to 1,500 megawatts with reliable and safe operation.

Figure 7:
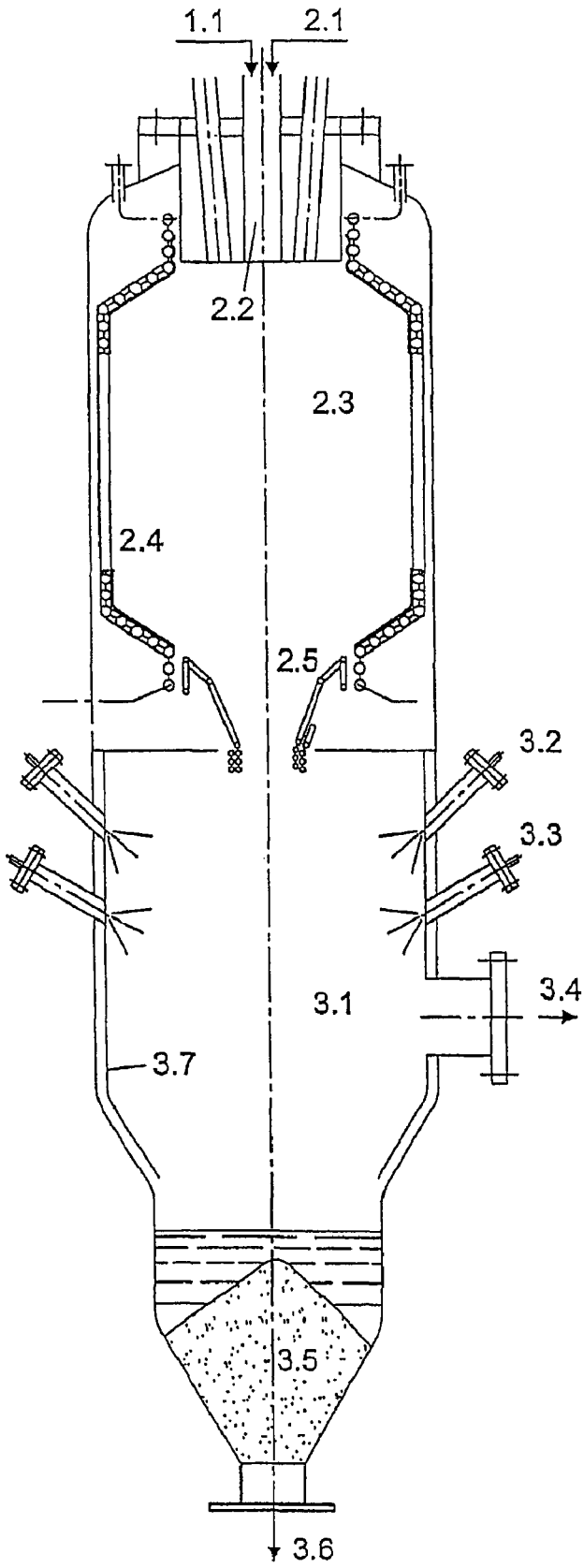
FIG. 7 shows a gasification reactor with full quenching.

FIG. 7 shows a gasification reactor 2 with full quenching 3, with the ignition and pilot burner 2.2 and the dust burners 2.1, through which the fluidizing gas or a slurry of fuel and liquid is fed into the reactor, being positioned in the center of the head of the reactor 2. The reactor has a gasification chamber 2.3 with a cooling shield 2.4 whose outlet opening 2.5 leads to the quench-cooler 3, whose quenching chamber 3.1 has quenching nozzles 3.2, 3.3, and a crude gas discharge 3.4, through which the finished crude gas can leave the quench-cooler 3. The slag that leaves the quench-cooler through an outlet opening 3.6 is cooled in the water bath 3.5.

Figure 8:
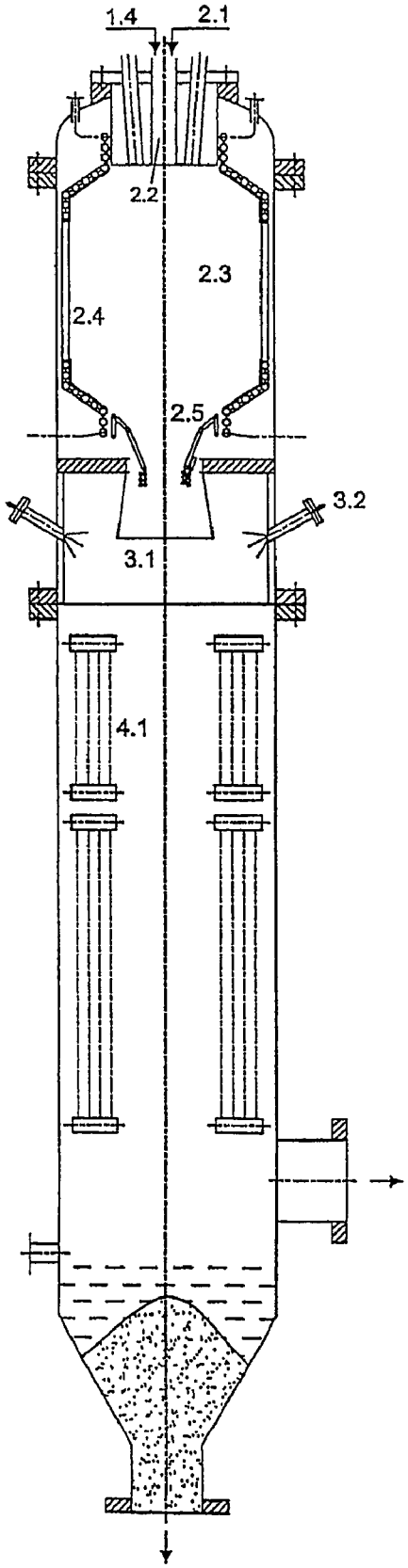
FIG. 8 shows a gasification reactor with partial quenching

FIG. 8 shows a gasification reactor 2 with partial quenching, with the gasification reactor located in the upper part, in which dust burners 2.1 gasify the dust from the transport line 1.4, and with an ignition and pilot burner 2.2 positioned in the center. Gasification reactor 2 has a bottom opening into quenching chamber 3.1, into both sides of which lead quenching nozzles 3.2, with waste heat boilers 4.1 placed below this.

The function will be described with a first example with reference to material flows and procedural processes:

240 Mg/h of pulverized coal is fed to a gasification reactor with a gross capacity of 1500 MW. This pulverized fuel prepared by drying and grinding crude bituminous coal has a moisture content of 5.8%, an ash content of 13 wt. %, and a calorific value of 24,700 kJ/kg. The gasification takes place at 1,550.degree. C., and the amount of oxygen needed is 208, 000 m.sup.3 I. H./h. The crude coal is first fed to a state-of-the-art drying and grinding system in which the water content is reduced to 1.8 wt. %. The grain size range of the pulverized fuel produced from the crude coal is between 0 and 200 .mum. The ground pulverized fuel (FIG. 1) is then fed to the metering system, the functional principle of which is shown in FIG. 5. The metering system consists of three identical units, as shown in FIG. 6, with each unit supplying ⅓ of the total amount of powder, or 80 Mg/h, each to a dust burner. The three dust burners assigned to them are at the head of the gasification reactor, whose principle is shown in FIG. 4. The usable pulverized fuel according to FIG. 5, which shows one unit of the powder metering system, goes from the operational bunker 1.1 to alternately operated pressurized sluices 1.2. There are 3 pressurized sluices in each unit. Pressurized suspension to the gasification pressure is performed with an inert gas such as nitrogen, for example, which is fed in through the line 1.6. After suspension, the pressurized pulverized fuel is fed to the metering tank 1.3. The pressurized sluices 1.2 are depressurized through the line 1.7 and can be refilled with pulverized fuel. The 3 mentioned pressurized sluices in each unit are loaded alternately, emptied into the metering tank, and depressurized. This process then begins anew. A dense fluidized bed is produced in the bottom of the metering tank 1.3 by feeding in a dry inert gas through the line 1.5, likewise nitrogen, for example, that serves as the transport gas; 3 dust-transport lines 1.4 are immersed in the fluidized bed. The amount of pulverized fuel flowing in the transport lines 1.4 is measured and regulated in relation to the gasification oxygen. The transport density is 250-420 kg/m.sup.3.

The gasification reactor 2 is shown and further explained in FIG. 6. The pulverized fuel flowing through the transport lines 1.4 to the gasification reactor 2 is discharged into 3 metering systems, each with a capacity of 80 Mg/h. The total of 9 transport lines 1.4 lead in groups of three each to 3 gasification burners 4.1 located at the head of reactor 2. At the same time, ⅓ of the total amount of oxygen of 208,000 m.sup.3 NTP/h is fed to each gasification burner. The dust burners are arranged symmetrically at angles of 120.degree., and in the center there is an ignition and pilot burner that heats the gasification reactor 2 and serves to ignite the dust burner 4.1. The gasification reaction, or the partial oxidation at temperatures of 1,550.degree. C., takes place in the gasification chamber 2.3, which is distinguished by a cooled reaction chamber contour 2.4. The monitored and measured amount of pulverized fuel is subjected to ratio regulation with the supplied oxygen, which provides that the ratio of oxygen to fuel neither exceeds nor falls below a range of .lamda.=0.35 to 0.65. The value of .lamda. represents the ratio of the needed amount of oxygen for the desired partial oxidation to the amount of oxygen that would be necessary for complete combustion of the fuel used. The amount of crude gas formed is 463,000 m.sup.3 NTP/h and is distinguished by the following analysis: TABLE-US-00001 H.sub.2 19.8 vol. % CO 70.3 vol. % CO.sub.2 5.8 vol. % N.sub.2 3.8 vol. % NH.sub.3 0.03 vol. % HCN 0.003 vol. % COS 0.04 vol. % H.sub.2 S 0.4 vol. %

The hot crude gas at 1,550.degree. C. leaves the gasification chamber 2.3 together with the liquid slag through the discharge 2.5 and is cooled to 212.degree. C. in the quenching chamber 3.1 by injecting water through the rows of nozzles 3.2 and 3.3, and is then sent through the outlet 3.4 to the crude gas scrubber 4, which serves as a water scrubber to remove dust. The cooled slag is collected in a water bath 3.5 and is discharged downward. The crude gas washed with water after the water scrubber 4 is sent for partial condensation 5 to remove fine dust <20 .mμm in size and salt mists not separated in the water scrubber 4. For this purpose, the crude gas is cooled by about 5.degree. C., with the salt particles dissolving in the condensed water droplets. The purified crude gas saturated with steam can then be fed directly to a catalytic crude gas converter or to other treatment stages.

According to Example 2, the process of pulverized fuel feed is to occur according to FIG. 2 and FIG. 6, and the actual gasification in the same way as in Example 1. The hot crude gas and the hot liquid slag likewise pass through discharge 2.5 into a quenching chamber 3.1, in which the crude gas is cooled to temperatures of 700-1,100.degree. C., not with excess water, but only by spraying in a limited amount of water through nozzle rings 3.2, and are then sent to the waste heat boiler 4.1 to utilize the heat of the crude gas to produce steam (FIG. 5). The temperature of the partially cooled crude gas is chosen so that the slag particles entrained by it are cooled in such a way as to prevent deposition on the heat exchanger tubes. As in Example 1, the crude gas cooled to about 200.degree. C. is then fed to the water scrubber and partial condensation.

Accordingly, while only a few embodiments of the present invention have been shown and described, it is obvious that many changes and modifications may be made thereunto without departing from the spirit and scope of the invention.

What is claimed is:

1. An apparatus for gasifying combustible dusts comprising hard coal, lignite, petroleum coke, or solid grindable residues, and slurries, comprising:

an entrained gasification reactor for gasifying the combustible dusts at temperatures ranging from 1200 to 1900 C and pressures of up to 80 bar;

wherein said gasification reactor comprises a plurality of gasification burners, each burner having an individual feed port;

wherein each gasification burner comprises a plurality of supply ports connected to said feed port;

a plurality of lock hopper and dosing systems arranged to supply dust or slurries to the gasification burners; and a plurality of supply lines corresponding in number with said plurality of supply ports leading from each lock hopper and dosing system to said supply ports, and configured to provide dust or slurries to each feed port of every single burner.

2. The apparatus as set forth in claim 1, wherein a number of the plurality of lock hopper and dosing systems is fewer than the number of the plurality of gasification burners.

3. The apparatus as set forth in claim 2, wherein there are three gasification burners and two lock hopper and dosing systems.

4. The apparatus as set forth in claim 3, wherein each gasification burner is simultaneously supplied from two lock hopper and dosing systems through at least two supply lines, each of these two supply lines being associated with a different lock hopper and dosing system.

5. The apparatus as in claim 4, wherein said plurality of lock hopper and dosing systems are configured and arranged such that the burners will continue to operate steadily upon failure of one of them wherein each of said two lock hopper and dosing systems are coupled to each burner in a redundant manner so that redundancy is provided in the event of a system failure.

6. The apparatus as set forth in claim 1 wherein said plurality of lock hopper and dosing systems are configured to simultaneously supply dust or slurries to feed at least two of said plurality of gasification burners.

7. The apparatus as in claim 1, wherein, a plurality of the gasification burners are supplied uniformly with combustible dust.

8. The apparatus as in claim 1, wherein, all of the gasification burners are supplied uniformly with combustible dust.

9. The apparatus as in claim 1, wherein each of said plurality of gasification burners is coupled to said plurality of lock hopper and dosing systems such that said plurality of gasification burners are configured and arranged to prevent crooked burning in the gasification reactor.

10. The apparatus as in claim 1, further comprising at least one metering system coupled to said entrained gasification reactor.

11. The apparatus as in claim 10, wherein said at least one metering system comprises at least one bunker, at least two pressurized sluices, and at least one metering tank wherein an output of said metering system is coupled to said entrained gasification reactor.

12. A high capacity reactor for the gasification of pulverized fuel from solid fuels such as bituminous coals, lignite coals, and their cokes petroleum cokes, cokes from peat or biomass, in entrained flow, with an oxidizing medium containing free oxygen at temperatures between 1,200 and 1,900 degrees C. and at pressures between atmospheric pressure and 80 bar, into a crude synthesis gas and slag, the reactor comprising:

a reactor head;

an ignition and pilot burner disposed at said head of the reactor;

a plurality of equal gasification burners disposed at said head of the reactor;

a plurality of lock hoppers and dosing systems arranged to supply said pulverized fuels to said plurality of equal gasification burners;

individual transport lines assigned to each gasification burner, said individual transport lines connecting and feeding said pulverized fuels from said lock hopper and dosing systems to the respective gasification burner;

wherein every single gasification burner is connected and fed by at least two different lock hoppers and dosing systems; and a measuring system configured to measure and regulate amounts of pulverized fuel and oxygen flowing in each of said plurality of equal gasification burners, said measuring system controlling the overall total amounts of pulverized fuel and oxygen flowing in the reactor.

13. The high capacity reactor as in claim 12, wherein said plurality of equal gasification burners comprise at least three gasification burners and wherein said plurality of lock hoppers comprise at least three lock hoppers and dosing systems, wherein each gasification burner of said plurality of equal gasification burners is connected and fed with pulverized fuel over two burner individual transport lines with every single one of said three lock hoppers and dosing systems.

14. The high capacity reactor as in claim 12, wherein said plurality of equal gasification burners comprise three gasification burners and said plurality of lock hoppers and dosing systems comprise at least two lock hoppers and dosing systems, wherein each gasification burner is connected and fed with pulverized fuel over two burner individual transport lines with every single of said two lock hoppers and dosing systems.

15. The high capacity reactor as in claim 12, wherein said plurality of lock hopper and dosing systems are configured and arranged such that the burners will continue to operate steadily upon failure of one of them wherein each of said at least two lock hopper and dosing systems are coupled to each of said plurality of equal gasification burners in a redundant manner so that redundancy is provided in the event of a system failure.

16. The high capacity reactor as in claim 12, wherein a plurality of the gasification burners are supplied uniformly with combustible dust.

17. The high capacity reactor as in claim 12, wherein all of the gasification burners are supplied uniformly with combustible dust.

18. The high capacity reactor as in claim 12, wherein each of said plurality of gasification burners is coupled to said plurality of lock hopper and dosing systems such that said plurality of gasification burners are configured and arranged to prevent crooked burning in the gasification reactor.

19. The high capacity reactor as in claim 12, wherein said measuring system further comprises least one bunker, at least two pressurized sluices, and at least one metering tank wherein an output of said metering system is coupled to said entrained gasification reactor.

20. The high capacity reactor as in claim 19, further comprising at least one fluidizing gas line which leads into said at least one metering tank from below, and which provides for fluidizing the fuel.

* * * * *